US005897101A

United States Patent [19]

Snyder

[11] Patent Number: 5,897,101

[45] Date of Patent: Apr. 27, 1999

[54] COLLAPSIBLE ENGINE HOIST

[76] Inventor: Ronald Jay Snyder, 3580 Keller Rd., St. Thomas, Pa. 17252

[21] Appl. No.: 08/816,513

[22] Filed: Mar. 13, 1997

[51] Int. Cl.[6] ..... B66F 5/02

[52] U.S. Cl. ..... 254/8 B

[58] Field of Search ..... 254/8 B, 8 R, 254/2 R, 2 B, 124

[56] References Cited

U.S. PATENT DOCUMENTS

| | | | |
|---|---|---|---|
| 4,334,668 | 6/1982 | Caris | 254/8 B |
| 5,076,448 | 12/1991 | Ballard | 254/8 B |
| 5,203,540 | 4/1993 | Lee | 254/8 B |

*Primary Examiner*—Robert C. Watson

[57] ABSTRACT

A new Collapsible Engine Hoist for hoisting an engine of a vehicle and being collapsible for convenient and compact storage. The inventive device includes a base tube member with a base extension section having a caster wheel telescopically engaged to each end of the base tube member. Extending from the base tube member are a plurality of spaced apart leg tube members each with a leg extension section having a caster wheel telescopically engaged to the end of each the leg tube member. A support post member having a clevis bracket at one end is pivotally mounted on a support post base extending between the leg tube members to permit pivoting of the support member between an erect position and a collapsed position. Pivotally mounted to the clevis bracket is a lifting beaam tube member having extension beam section telescopically engaged to one end of the lifting tube member. The extension beam section includes a flexible member having a hook portion for suspending a load from it. A jack pivotally mounted on the support post member and detachably attached to the lift beam tube member provides a means for pivoting the lifting beam tube member relative to the support post member when in the erect position. At least one support brace pivotally mounted on the base tube member and detachably attached to the support post member provides support to the support post member when positioned in an erect position. A leg support brace extending between the leg tube members provides support to the lifting beam tube member when in the collapsed position.

7 Claims, 3 Drawing Sheets

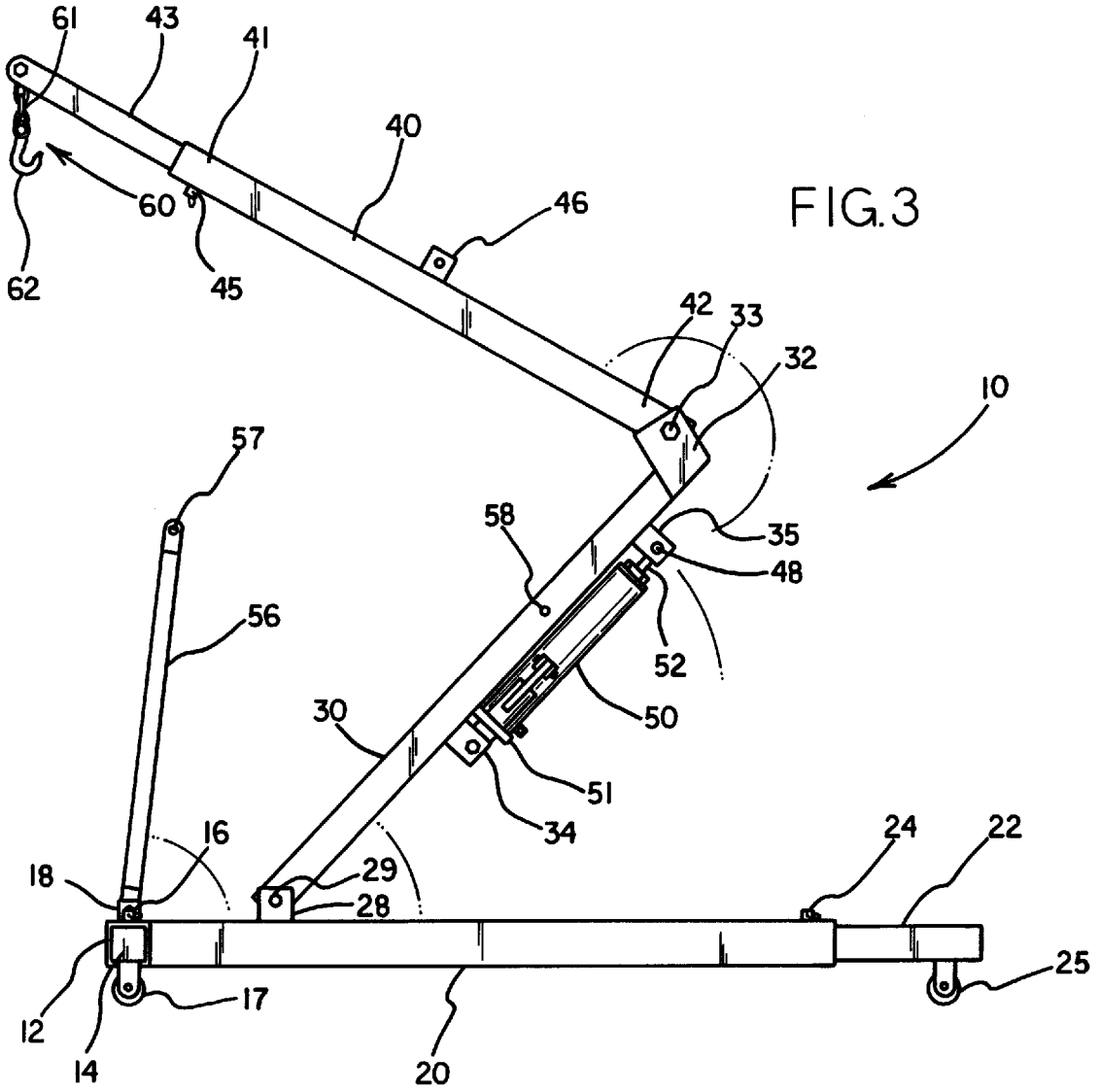
FIG. 3
FIG. 4
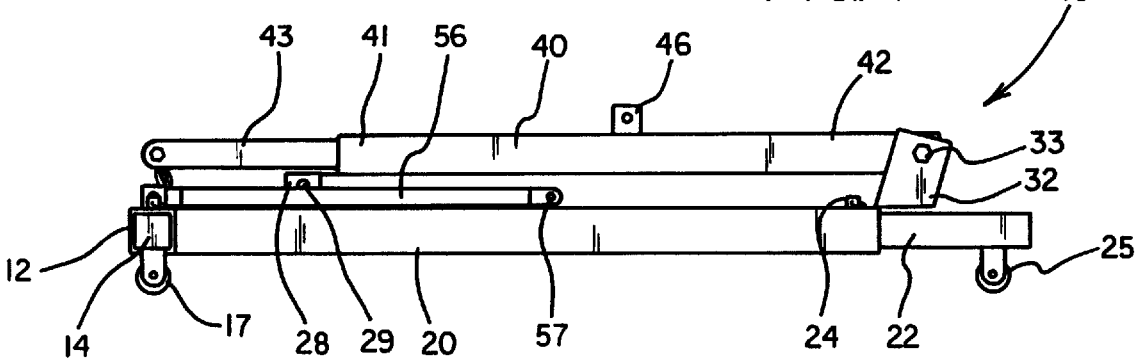

COLLAPSIBLE ENGINE HOIST

BACKGROUND OF THE INVENTION

1. Field of the Invention

The present invention relates to engine hoists and more particularly pertains to a new Collapsible Engine Hoist for hoisting an engine of a vehicle and being collapsible for convenient and compact storage.

2. Description of the Prior Art

The use of engine hoists is known in the prior art. More specifically, engine hoists heretofore devised and utilized are known to consist basically of familiar, expected and obvious structural configurations, notwithstanding the myriad of designs encompassed by the crowded prior art which have been developed for the fulfillment of countless objectives and requirements.

Known prior art engine hoists include U.S. Pat. No. 5,261,640; U.S. Pat. No. 5,052,566; U.S. Pat. No. 4,770,304; U.S. Pat. No. Des. 349,996; U.S. Pat. No. 4,497,469; and U.S. Pat. No. 4,090,625.

While these devices fulfill their respective, particular objectives and requirements, the aforementioned patents do not disclose a new Collapsible Engine Hoist. The inventive device includes a base tube member with a base extension section having a caster wheel telescopically engaged to each end of the base tube member. Extending from the base tube member are a plurality of spaced apart leg tube members each with a leg extension section having a caster wheel telescopically engaged to the end of each the leg tube member. A support post member having a clevis bracket at one end is pivotally mounted on a support post base extending between the leg tube members to permit pivoting of the support member between an erect position and a collapsed position. Pivotally mounted to the clevis bracket is a lifting beam tube member having extension beam section telescopically engaged to one end of the lifting tube member. The extension beam section includes a flexible member having a hook portion for suspending a load from it. A jack pivotally mounted on the support post member and detachably attached to the lift beam tube member provides a means for pivoting the lifting beam tube member relative to the support post member when in the erect position. At least one support brace pivotally mounted on the base tube member and detachably attached to the support post member provides support to the support post member when positioned in all erect position. A leg support brace extending between the leg tube members provides support to the lifting beam tube member when in the collapsed position.

In these respects, the Collapsible Engine Hoist according to the present invention substantially departs from the conventional concepts and designs of the prior art, and in so doing provides an apparatus primarily developed for the purpose of hoisting an engine of a vehicle and being collapsible for convenient and compact storage.

SUMMARY OF THE INVENTION

In view of the foregoing disadvantages inherent in the known types of engine hoists now present in the prior art, the present invention provides a new Collapsible Engine Hoist construction wherein the same can be utilized for hoisting an engine of a vehicle and being collapsible for convenient and compact storage.

The general purpose of the present invention, which will be described subsequently in greater detail, is to provide a new Collapsible Engine Hoist apparatus and method which has many of the advantages of the engine hoists mentioned heretofore and many novel features that result in a new Collapsible Engine Hoist which is not anticipated, rendered obvious, suggested, or even implied by any of the prior art engine hoists, either alone or in any combination thereof.

To attain this, the present invention generally comprises a base tube member with a base extension section having a caster wheel telescopically engaged to each end of the base tube member. Extending from the base tube member are a plurality of spaced apart leg tube members each with a leg extension section having a caster wheel telescopically engaged to the end of each the leg tube member. A support post member having a clevis bracket at one end is pivotally mounted on a support post base extending between the leg tube members to permit pivoting of the support member between an erect position and a collapsed position. Pivotally mounted to the clevis bracket is a lifting beam tube member having extension beam section telescopically engaged to one end of the lifting tube member. The extension beam section includes a flexible member having a hook portion for suspending a load from it. A jack pivotally mounted on the support post member and detachably attached to the lift beam tube member provides a means for pivoting the lifting beam tube member relative to the support post member when in the erect position. At least one support brace pivotally mounted on the base tube member and detachably attached to the support post member provides support to the support post member when positioned in an erect position. A leg support brace extending between the leg tube members provides support to the lifting beam tube member when in the collapsed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Collapsible Engine Hoist apparatus and method which has many of the advantages of the engine hoists mentioned heretofore and many novel features that result in a new Collapsible Engine Hoist which is not anticipated, rendered obvious, suggested, or even implied by any of the prior art engine hoists, either alone or in any combination thereof.

It is another object of the present invention to provide a new Collapsible Engine Hoist which may be easily and efficiently manufactured and marketed.

It is a further object of the present invention to provide a new Collapsible Engine Hoist which is of a durable and reliable construction.

An even further object of the present invention is to provide a new Collapsible Engine Hoist which is susceptible of a low cost of manufacture with regard to both materials and labor, and which accordingly is then susceptible of low prices of sale to the consuming public, thereby making such Collapsible Engine Hoist economically available to the buying public.

Still yet another object of the present invention is to provide a new Collapsible Engine Hoist which provides in the apparatuses and methods of the prior art some of the advantages thereof, while simultaneously overcoming some of the disadvantages normally associated therewith.

Still another object of the present invention is to provide a new Collapsible Engine Hoist for hoisting an engine of a vehicle and being collapsible for convenient and compact storage.

Yet another object of the present invention is to provide a new Collapsible Engine Hoist which includes a base tube member with a base extension section having a caster wheel telescopically engaged to each end of the base tube member. Extending from the base tube member are a plurality of spaced apart leg tube members each with a leg extension section having a caster wheel telescopically engaged to the end of each the leg tube member. A support post member having a clevis bracket at one end is pivotally mounted on a support post base extending between the leg tube members to permit pivoting of the support member between an erect position and a collapsed position. Pivotally mounted to the clevis bracket is a lifting beam tube member having extension beam section telescopically engaged to one end of the lifting tube member. The extension beam section includes a flexible member having a hook portion for suspending a load from it. A jack pivotally mounted on the support post member and detachably attached to the lift beam tube member provides a means for pivoting the lifting beam tube member relative to the support post member when in the erect position. At least one support brace pivotally mounted on the base tube member and detachably attached to the support post member provides support to the support post member when positioned in an erect position. A leg support brace extending between the leg tube members provides support to the lifting beam tube member when in the collapsed position.

Still yet another object of the present invention is to provide a new Collapsible Engine Hoist that allows a person having limited storage area to have a engine hoist.

Even still another object of the present invention is to provide a new Collapsible Engine Hoist that is fully mobile.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side view of the present invention in a position between the collapsed position and the erect position.

FIG. 4 is a side view of the Collapsible Engine Hoist in the collapsed position.

DESCRIPTION OF THE PREFERRED EMBODIMENT

Figure 1:
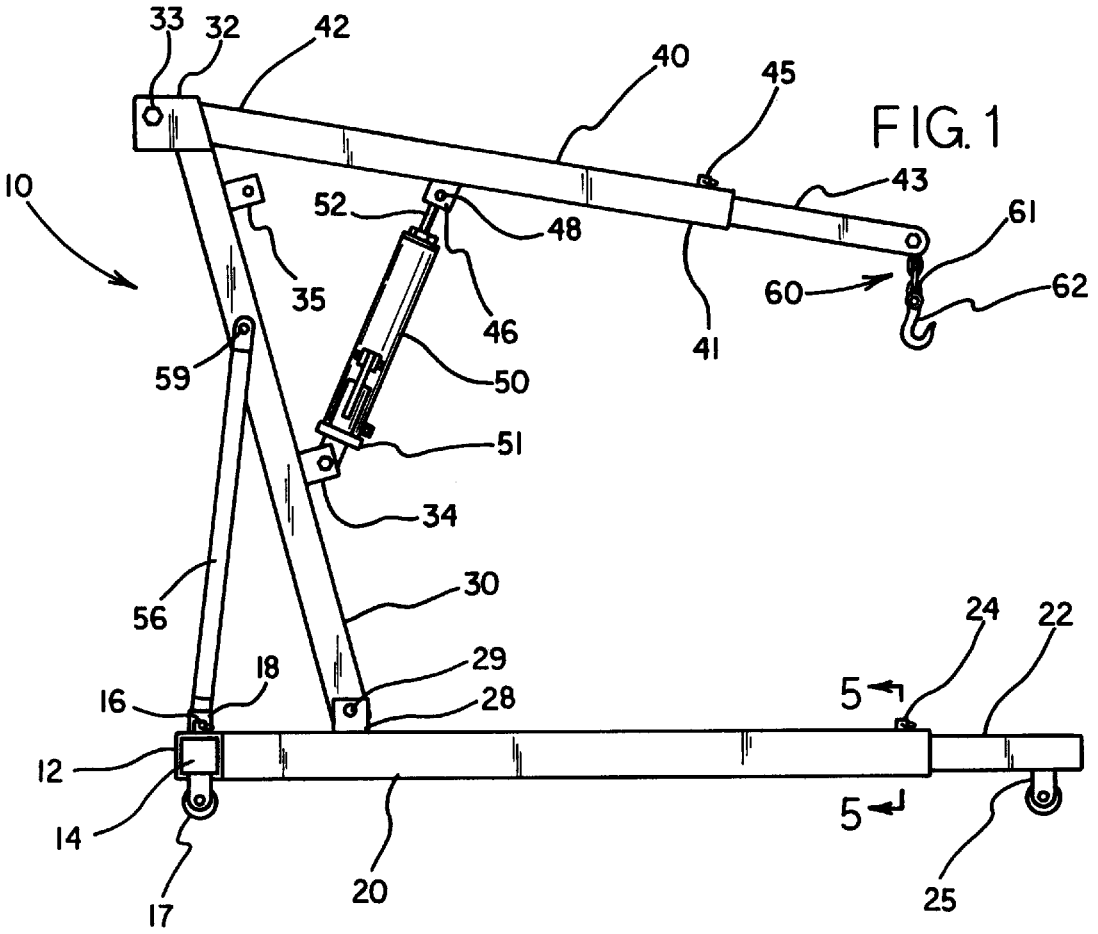
FIG. 1 is a schematic side view of a new Collapsible Engine Hoist in the erect position according to the present invention.
Figure 2:
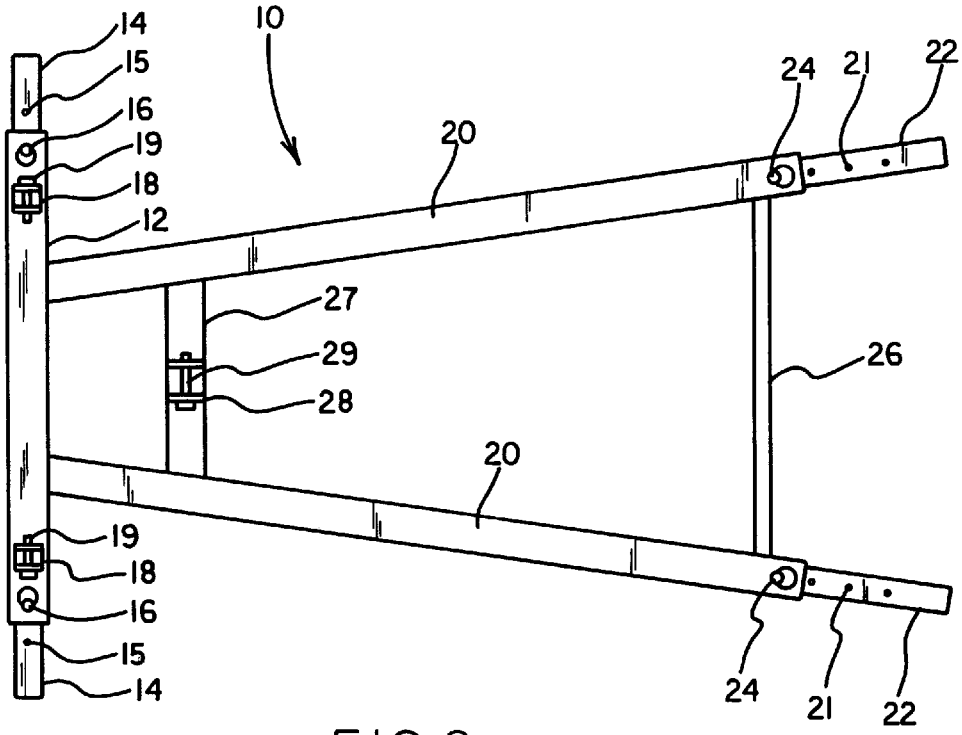
FIG. 2 is a schematic top plan view of the base elements of the invention.
Figure 5:
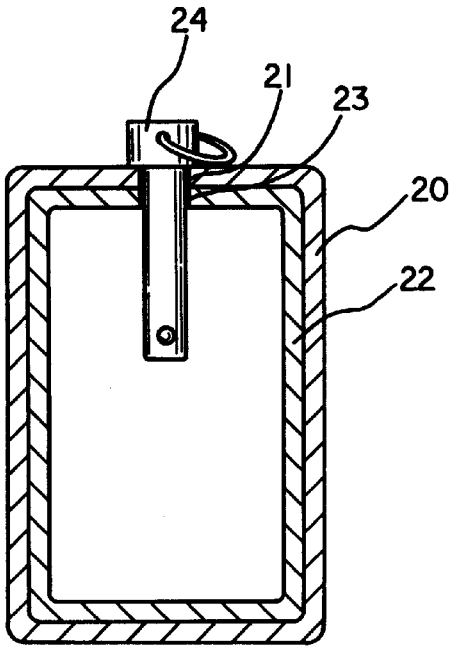
FIG. 5 is a cross sectional view of a leg tube member and a leg extension section taken along Line 5—5 of FIG. 1.
Figure 6:
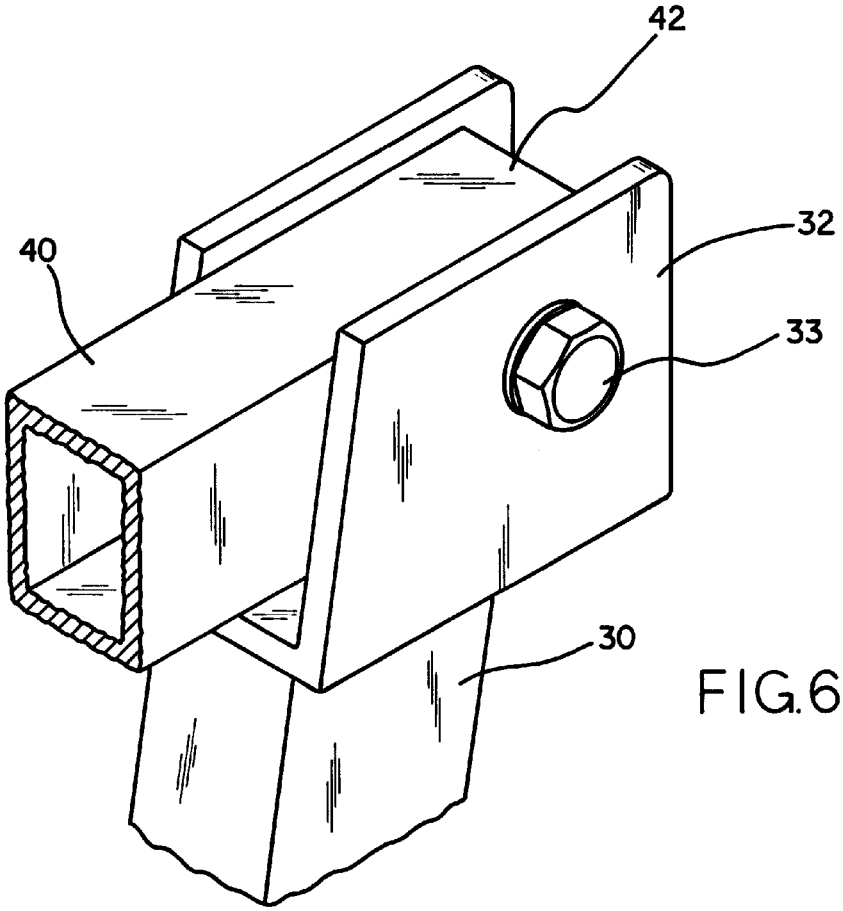
FIG. 6 is a partial perspective view showing the clevis bracket of the support post member pivotally coupled to the clevis bracket attachment end of the lifting beam tube member.

With reference now to the drawings, and in particular to FIGS. 1 through 6 thereof, a new Collapsible Engine Hoist embodying the principles and concepts of the present invention and generally designated by the reference numeral 10 will be described.

As best illustrated in FIGS. 1 through 6, the Collapsible Engine Hoist 10 is designed so that it may be positioned in either an erect position for suspending a load from the lifting beam member 40 or in a collapsed position for storage and transport convenience.

As depicted in FIG. 1, the collapsible engine hoist 10 has an elongate base tube member 12 which has a base extension section 14 telescopically engaged to each of its two longitudinal ends. Each base extension section 14 has a plurality of longitudinally spaced apart openings 15. The base extension section 14 may be extended and retracted so that the openings 15 may be aligned with an opening (not shown) through each end of base tube member 12. A securing pin 16 may then be extended through the aligned openings to secure the base extension sections 14 to the base tube member 12. When extended from the base tube member 12, the base extension sections 14 help provide additionally stability to the collapsible engine hoist 10, and when retracted, aid in the convenience for storage and transport of the collapsible engine hoist 10. A caster wheel 17 is attached to the bottom of each base extension section 14. The caster wheels 17 help support the base tube member 12 on the ground and aid in the positioning of the collapsible engine hoist 10 near a vehicle while in use.

Extending from the base tube member 12 in a horizontal plane to the ground are a plurality of spaced apart elongate leg tube members 20. In the preferred embodiment of this invention, the extended end of each leg tube members 20 has a leg extension section 22 telescopically engaged to it. Like each base extension sections 14, each leg extension section 22 has a plurality of longitudinally spaced apart openings 23.

The leg extension sections 22 may be extended and retracted so that the openings 23 may be aligned with an opening 21 through the end of each leg tube member 20. A securing pin 24 may then be extended through the aligned openings to secure the base extension sections 14 to the base tube member 12. When extended from the leg tube member 20, the leg extension members 22 help provide additionally stability to the collapsible engine hoist 10, and when retracted, aid in the convenience for storage and transport of the collapsible engine hoist 10. Also like the base extension sections 14, each leg extension section 22 has a caster wheel 25 attached to it.

Preferably, a support post base 27 is extended between the leg tube members 20 for providing support to the support post member 30. Pivotally mounted on a bracket 28 on the support post base 27 is an elongated support post member 30. The support post member 30 is secured at its lower end to the bracket 28 by a bolt 29 extending through the bracket 28 and the support post member 30. The support post member 30 is pivotally mounted on the support post base 27 to permit the pivoting of the support member 30 between the erect position as depicted in FIG. 1 and the collapsed position as depicted in FIG. 4.

The collapsible engine hoist 10 also includes an elongated lifting beam tube member 40. The lifting beam tube member 40 has a clevis bracket attachment end 42 and an extension end 41. The clevis bracket attachment end 42 is pivotally coupled to the U-shaped clevis bracket 32 located on the upper end of the support post member 30. The clevis bracket attachment end 42 is secured to the clevis bracket 32 by a bolt 33. This pivot attachment allows the lifting beam tube member 40 to be pivoted between the erect position as shown by FIG. 1 to the collapsed position as shown by FIG. 4. FIG. 3 shows how the lifting beam tube member 40 is pivoted to maneuver it between the two positions.

Telescopically engaged to the extension end 41 of the lifting tube member 40 is an extension beam section 43. The extension beam section 43 has a suspension means 60 towards the end of the extension beam section 43 furthest away from the lifting beam tube member 40. The suspension means 60 is designed for suspending a load such as an engine from the extension beam section 43. One preferred embodiment of the suspension means 60 is a flexible member 61 with a hook portion 62. The flexible member 61 may be a chain or a cable capable of supporting a heavy load such as an engine.

Like the base extension sections 14 and the leg extension sections 22, the extension beam section 43 has a plurality of longitudinally spaced apart openings 44. The extension beam section 43 may be extended and retracted from the lifting beam tube member 40 so that the openings 44 may be aligned with an opening (not shown) through extension end 41 of the lifting beam tube member 40. A securing pin 45 may then be extended through the aligned openings to secure the extension beam section 43 to the lifting beam tube member 40. When extended from the lifting beam tube member 40, the extension beam member 43 can be positioned to an optimal position for suspending a load as required by the situation.

The collapsible engine hoist also includes at least one support brace 56 pivotally mounted at one end to a brace bracket 18 on the base tube member 12. The preferred embodiment of the invention includes two support braces 56. The support brace is secured to the brace bracket on the base tube member by means of a bolt 19. The other end of the support brace 56 is detachably attached to the support post member 30. When the invention is in the extended position, the support brace 56 is attached to the support post member 30 by first aligning the opening 57 in the support brace 56 with an corresponding opening 58 in the support post member 30 and then inserting a securing pin 59 through the aligned openings to attach the support brace 56 to the support post member 30. The support brace 56 provides support to the support post member 30 to help hold it in the erect position. When collapsing the collapsible engine hoist 10, the support braces 56 are detached from the support post member 30 and pivoted downwards so that their upper end is in horizontal alignment with the end mounted to the base tube member 12.

A leg support brace 26 is extended between the leg tube members 20 and is spaced apart from the support post base 27. The leg support brace 26 is included in the collapsible engine hoist 10 to provide support to keep the lifting beam tube member 40 and support post member 30 horizontal with respect to the leg tube members 20 when the invention is in the collapsed position. The leg support brace 26 also provides extra structural support and strength to the leg tube members 20.

A jack 50 is attached to both the lifting beam tube member 40 and the support post member 30 when the invention is in the erect position. The jack 50 provides a means for pivoting the lifting beam tube member 40 relative to the support post member 30 in order to raise and lower a load suspended from the extension beaam section 43. The jack 50 may be of any traditional jack design and has a jack base 51 and an extendible jack rod 52. The jack base is pivotally mounted to a jack base bracket 34 on the support post member 30. The jack rod 52 is detachably attached to the jack rod bracket plate 46 on the lift beam tube member 40 when the invention is in the erect position. The jack rod is coupled to the jack rod bracket plate 46 by a securing pin 48 extending through the jack rod 52 and the jack rod bracket plate 46. When the jack rod is detached from the jack rod bracket plate 46 it permits the lifting beam tube member 40 to be positioned in a collapsed position. When detached, the jack rod 52 may be detachably mounted to a similar jack rod bracket plate 35 on the support post member 30 to help keep the collapsible engine hoist 10 compact when collapsed.

In use, when collapsing the collapsible engine hoist 10 from the erect position to the collapsed position, the support braces 56 are detached from the support post member 30 and the jack rod 52 is detached from the jack rod bracket plate 46 on the lifting beam tube member 40 and mounted to the jack rod bracket plate 35 on the support post member 30 with the securing pin 45. As shown in FIG. 3, the lifting beam tube member 40 is pivoted upwardly so that the extension beam section 43 is towards the base tube member 12. The support post member 30 is pivoted so that the clevis bracket 32 is towards the leg extension sections 22 and the support post member 30 is resting horizontally on the leg support brace 26. The lifting beam tube member 40 should then be horizontal with the support post member 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible engine hoist, comprising:

a base having a plurality of ground engaging wheels;

an elongate support post member having a pair of opposite ends, and a longitudinal axis extending between said ends of said support post member;

a first of said ends of said support post member being pivotally coupled to said base;

a telescopically extendable elongate lifting beam having opposite proximal and distal ends, and a longitudinal axis extending between said proximal and distal ends of said of said lifting beam;

said proximal end of said lifting beam being pivotally coupled to a second of said ends of said support post member;

a jack having a jack base and an extendible jack rod, said jack base being pivotally mounted on said support post member, said jack rod being detachably attached to said lift beam; and said support post member having a jack rod bracket plate for detachably attaching said jack rod when said jack rod is detached from said lift beam.

2. A collapsible engine hoist, for being positionable in either an erect position or a collapsed position, said collapsible engine hoist comprising:

an elongate base tube member having a pair of longitudinal ends;

a base extension section having a caster wheel for supporting said base tube member on the ground, said base extension section being telescopically engaged to each longitudinal end of said base tube member;

a plurality of spaced apart elongate leg tube members being extended in a substantially horizontal plane from said base tube member and being terminated in an end;

a leg extension section having a caster wheel and being telescopically engaged to said end of each said leg tube member;

a support post base being extended between said leg tube members for providing support to a support post member;

a leg support brace being spaced apart from said support post base and being extended between said leg tube members, said leg support brace for providing support to a lifting beam tube member when in collapsed position;

an elongate support post member having a clevis bracket at one end and being pivotally mounted on said support post base to permit pivoting of said support member between an erect position and a collapsed position;

an elongate lifting beam tube member having a clevis bracket attachment end and an extension end, said clevis bracket attachment end being pivotally coupled to said clevis bracket of said support post member;

an extension beam section having a suspension means for suspending a load from said extension beam section, said extension beam section being telescopically engaged to said extension end of said lifting tube member;

a means for pivoting said lifting beam tube member relative to said support post member to raise and lower a loaded being suspended from said extension beam section;

at least one support brace being pivotally mounted on said base tube member and being detachably attached to said support post member for providing support to said support member when positioned in an erect position;

wherein said means for pivoting said lifting beam tube member relative to said support post member comprises a jack having a jack base and an extendible jack rod, said jack base being pivotally mounted on said support post member, said jack rod being detachably attached to said lift beam tube member for permitting said lifting beam tube member to be positioned in a collapsed position when detached;

wherein said support post member further includes a jack rod bracket plate for detachably attaching said jack rod when said collapsible engine hoist is positioned in a collapsed position.

3. The collapsible engine hoist of claim 2, wherein suspension means is a flexible member terminating in a hook portion for attaching to a load.

4. The collapsible engine hoist of claim 3, wherein said jack rod bracket plate is positioned on said support post member between said jack base and said second end of said support post member.

5. The collapsible engine hoist of claim 3, wherein said base further comprises an elongate base tube member having a pair of longitudinal ends, a base extension section being telescopically engaged to each longitudinal end of said base tube member, a first of said ground engaging wheels being coupled to said base extension section, a plurality of spaced apart elongate leg tube members being extended in a substantially horizontal plane from said base tube member and being terminated at an end, a leg extension section being telescopically engaged to said end of each said leg tube member, said leg extension section having a second of said ground engaging wheels, a support post base being extended between said leg tube members, and a leg support brace being spaced apart from said support post base and being extended between said leg tube members.

6. The collapsible engine hoist of claim 3, further comprising a flexible member depending from said distal end of said lifting beam, said flexible member terminating at a hook portion adapted for attaching a load thereto.

7. The collapsible engine hoist of claim 3, further comprising a support brace being pivotally coupled to said base and being detachably attached to said support post member.

* * * * *